US009121143B2

(12) United States Patent
Hagen et al.

(10) Patent No.: US 9,121,143 B2
(45) Date of Patent: Sep. 1, 2015

(54) SELF-PROPELLED CONSTRUCTION MACHINE

(71) Applicant: BOMAG GmbH, Boppard (DE)

(72) Inventors: Irina Hagen, Halsenbach (DE); Hermann Christ, Bubach (DE); Moritz Nick, Boppard (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 14/103,283

(22) Filed: Dec. 11, 2013

(65) Prior Publication Data

US 2014/0169881 A1 Jun. 19, 2014

(30) Foreign Application Priority Data

Dec. 11, 2012 (DE) ..... 10 2012 024 221

(51) Int. Cl.
*E01C 19/48* (2006.01)

(52) U.S. Cl.
CPC ..... *E01C 19/48* (2013.01)

(58) Field of Classification Search
CPC ..... E01C 19/48; E01C 19/42; E01C 19/00; E01C 19/185; B60K 17/105; B60K 17/36
USPC ..... 404/83, 101, 118; 180/306, 307, 24.07; 280/678, 124.16
See application file for complete search history.

(56) References Cited

U.S. PATENT DOCUMENTS 2,132,059 A * 10/1938 Trembly ..... 404/123
2,391,948 A * 1/1946 Couse ..... 280/676
2,721,405 A * 10/1955 Gardner ..... 172/784
2,775,925 A * 1/1957 Greiner ..... 404/123
3,212,263 A * 10/1965 Hann ..... 60/389
3,366,399 A * 1/1968 Hunger ..... 280/678
3,409,100 A * 11/1968 Kronqvist ..... 180/6.54
4,056,158 A * 11/1977 Ross ..... 180/6.48
4,462,477 A * 7/1984 Mastro ..... 180/24.02
5,016,905 A * 5/1991 Licari ..... 280/677
5,339,611 A * 8/1994 Roderfeld et al. ..... 56/10.2 R
5,655,615 A * 8/1997 Mick ..... 180/24.02
6,364,340 B1 * 4/2002 Taylor ..... 280/676
6,550,505 B2 * 4/2003 Nault et al. ..... 144/336

(Continued)

FOREIGN PATENT DOCUMENTS

DE 299 20 556 U1 2/2000

OTHER PUBLICATIONS

Joseph Voegele AG, English Translation of Claim 1 for German Application No. DE29920556U1, published on Feb. 17, 2000 (1 page).

(Continued)

*Primary Examiner* — Abigail A Risic
(74) *Attorney, Agent, or Firm* — Wood Herron & Evans, LLP

(57) ABSTRACT

The invention relates to a self-propelled construction machine, for example, a road finisher, comprising a vehicle chassis and having a tandem axle unit and a single wheel on each side of the vehicle, wherein each tandem axle unit comprises a twin axle carrier and also a regulating device, by means of which the twin axle carrier can be pivoted relatively to the vehicle chassis. Each tandem axle unit is mounted on a lever arm, which is mounted for rotation about a pivot axle on the vehicle chassis, and which is engaged by the regulating device.

20 Claims, 6 Drawing Sheets

(56) References Cited

U.S. PATENT DOCUMENTS

| | | | | |
|---|---|---|---|---|
| 8,016,068 | B2 * | 9/2011 | Daniel et al. | 180/306 |
| 2009/0120709 | A1 * | 5/2009 | Iida | 180/307 |
| 2011/0262227 | A1 * | 10/2011 | Christ et al. | 404/84.05 |
| 2012/0051839 | A1 * | 3/2012 | Begley et al. | 404/72 |

OTHER PUBLICATIONS

German Patent Office, Search Report for German Application No. DE 10 2012 024 221.2, mailed Oct. 2, 2013 (3 pages).

* cited by examiner

Left-Hand Tandem-Axle Unit Right-Hand Tandem-Axle Unit

SELF-PROPELLED CONSTRUCTION MACHINE

CROSS-REFERENCE TO RELATED APPLICATIONS

The present application claims priority under 35 U.S.C. §119 of German Patent Application No. 10 2012 024 221.2, filed Dec. 11, 2012, the disclosure of which is hereby incorporated herein by reference in its entirety.

FIELD OF THE INVENTION

The present invention relates to a self-propelled construction machine, for example, a road finisher, comprising a vehicle chassis, and having a tandem axle unit and a separate wheel on each side of the vehicle, wherein each tandem axle unit has a twin axle carrier and a regulating device by means of which the twin axle carrier can be pivoted relatively to the vehicle chassis.

BACKGROUND OF THE INVENTION

Construction machines of this kind are known, in particular, in road construction operations during which road finishers are used to construct asphalt highways. These construction machines can, in principle, be equipped to run on wheels, caterpillar tracks, or a combination of wheels and tracks.

In the case of a tandem axle unit, also referred to as a bogie or pendulum axle unit, two axles are mounted one behind the other on a suspended and pivoted twin axle carrier. In this way the wheels can absorb unevenness of the surface of the ground such that the unevenness has no influence on the chassis. Twin axle carriers thus provide a means of stabilizing the machine as it travels, with the absorbing action of each twin axle carrier being possible independently of that of any other twin axle carrier.

These construction machines are usually in themselves very heavy. Furthermore, they are equipped with large-volume containers for accommodating construction material, with the result that the wheel axles must bear heavy loads. Apart from absorbing ground irregularities, tandem axle units have the advantage that they allow for displacement of the center of gravity of the machine and thus make it possible to alter the effective distribution of the machine load on its respective front and rear axles. If the pendulum axle of the tandem axle unit forms the front axle of the vehicle, and the separate wheels are disposed on the rear axle, as is the case in a road finisher, it is possible, for example, to move the center of gravity of the machine forward by raising the front wheels of the tandem axle unit so as to reduce the effective machine load on the rear axle. Particularly, when these machines are being driven, such a change in load distribution on the axles is advantageous, since it makes it possible to keep to the maximum permitted axle loads when the machine is driven on public highways. When used at a construction site, it can again be advantageous to place particularly heavy axle loads on the front or rear axles in order, for example, to increase the effectiveness of a screed plate disposed on a rear wheel.

A road finisher having two tandem axle units is described in DE 29920556 U1, in which case the pendulum axles are mounted directly on the chassis. In order to achieve a reduction in axle load on the rear axles by moving the center of gravity of the road finisher, one embodiment includes a regulating device, for example, a hydraulic cylinder, which acts on a supporting arm of the twin axle carrier. The regulating device is thus either subject to heavy strains when cooperating with the twin axle carrier or restricts the pendular motion mode to the extent that no further free pendular motion is guaranteed.

DE 29920556 U1 discloses, furthermore, an arrangement of the tandem axle units such that they can be moved longitudinally along the machine, likewise allowing for displacement of the center of gravity of the machine. Such a construction is, however, technically very demanding and thus expensive to produce. In addition, displacement of the twin axle carrier or related parts thereof requires a lot of physical space, and this has a negative influence on the basic dimensions of the machine.

In addition to the displacement of the center of gravity of the machine as determined by operating conditions, it is furthermore of interest to ascertain the effective axle loads of the machine, and to design the chassis in such a way so as to make it vertically adjustable, in order to optimize the construction process. A vertically adjustable road finisher makes it possible, for example, to align it exactly with trucks supplying construction material or removing excavated material. The combination of a vertically adjustable chassis with a freely pendular twin axle carrier, while allowing for the required displacement of the center of gravity, has hitherto not or only to an unsatisfactory degree been accomplished.

SUMMARY OF THE INVENTION

It is an object of the present invention to provide a construction machine as described above, which allows for displacement of the center of gravity of the machine as needed, and in which, at the same time, the distance of the chassis from the ground can be adjusted in a simple and safe manner.

This object is achieved in that each tandem axle unit is mounted on a lever arm, which is itself mounted for pivoting about a pivot axle on the vehicle chassis, and in that the regulating device engages with the lever arm.

According to one embodiment of the present invention, the construction machine has a pendulum axle, which is disposed on the vehicle chassis at a position parallel to the pivot axle and offset therefrom, and serves to accommodate the twin axle carrier such that it can execute pendular motion. Loads that are taken up by the vehicle chassis and absorbed by the respective pivot axles are then further directed via the lever arm to the pendulum axle, whence they are absorbed by the twin axle carrier and thence by the wheels and by the ground. Regarded statically, there is thus an eccentricity between the pendulum and pivot axles. The regulating device according to one embodiment of the present invention intercepts the rotational torque effect caused by this eccentricity, being designed such that it can fix and/or adjust the position of the pivot axle relatively to the pendulum axle, and, more particularly, that it can displace the pendulum axle relatively to the pivot axle.

In this way, it is possible to change the position of, and in particular, to adjust the height of, the pivot axle and thus of the vehicle chassis, relatively to the pendulum axle for the purpose of leveling uneven ground. This change in position is at least partly actively achieved by the weight of the machine and/or by the regulating device, e.g., by way of linear or rotational power elements, etc. It is further possible, by way of the regulating device and the eccentric arrangement of the pivot axle in relation to the pendulum axle, to cause force to bear on the lever arm and, about the pendulum axle, to the twin axle carrier, and thus to pivot the twin axle carrier and to displace the center of gravity of the machine.

The lever arm is preferably an eccentric beam or similar load-bearing element, extending from the pivot axle to the pendulum axle. In this respect, all embodiments of load-bearing elements that are known from the prior art, more particularly, for transferring rotational and bending torques, can be used.

The regulating device has preferably at least one force detecting element, by means of which the forces acting on the regulating device can be detected. In this way it is possible, inter alia, to detect that portion of the machine loads which is transferred from the pivot axle to the pendulum axle.

When in a pivoted position, the pivot axle is preferably connected by the lever arm to the pendulum axle such that the proportion of the machine load transferred to the pivot axle is only transferred about the pendulum axle to the wheel which is in contact with the ground. That is to say, that in the pivoted position, in which the twin axle carrier can preferably execute pendular motion freely about the pendulum axle, all of that portion of the machine load that is transferred to the pivot axle and thence to the front wheel, is transferred through the pendulum axle and thence to the ground. This guarantees that free pendular motion is not impeded. Using the force detecting element of the regulating device, it is possible to detect the exact axle load on the wheel during execution of pendular motion, when suitable force detecting elements are used.

In one embodiment, the pivot axle, or a component associated therewith, is guided within a free pendular motion space in the twin axle carrier. During pendular motion operation, the twin axle carrier makes it possible to absorb uneven ground unimpeded, in that it executes pendular motion about the pendulum axle and, by executing vertical motion, transfers the unevenness of the ground to the drive elements. Due to the guidance of the pivot axle within the twin axle carrier, unimpeded pendular motion becomes possible, despite which a compact design of the machine and, in particular, of the wheels is still possible.

The free pendular motion space has preferably at least one limit stop, which can act on a stop bar of the pivot axle or a component associated therewith, in order to restrict the pendular motion. This stop bar can be, say, a prolongation of the pivot axle, which engages the free pendular motion space in such a way that during extreme deflections during pendular motion it strikes a limit stop. The stop bar can be so designed that it restricts the pendular motion in one direction at only one side of the free pendular motion space, or it can be designed to restrict the pendular motion in both directions at either side of the free pendular motion space.

The free pendular motion space (or the position of the limit stop in the space) is normally designed such that a pendular motion is restricted to ±30°, and, more particularly, to ±20° about the pendulum axle.

In a special embodiment, the free pendular motion space is designed in the form of an elongated hole, of which the short sides serve as the limit stops. With a free pendular motion space designed in this way, it is possible to ensure reliable movement of the stop bar and locking thereof at the limit stop(s).

The limit stop or the stop bar are preferably designed such that they can cooperate by way of the regulating device and/or the weight of the machine. It is thus possible, for example, to configure the pivot axle and the pendulum axle relatively to each other such that the resulting eccentric rotational torque is intercepted by the power element and thus the relative positions of the two axles remain fixed in relation to each other. By "opening" the power element it is possible to rotate the pivot axle relatively to the pendulum axle by way of the lever arm and, more particularly, to effect lowering thereof. Such movement can of course also take place actively by means of a power element so as to rotate the pivot axle actively about the pendulum axle and thus to lower the vehicle chassis and/or to rotate the twin axle carrier about the pivot axle and, in particular, to raise at least one drive element.

Once the limit stop and the stop bar have engaged each other, the pendular motion of the twin axle carrier is blocked in at least one direction and free pendular motion thereof is then no longer possible. This situation corresponds, to a certain extent, to the function of a rigid axle. It is important that the embodiment of the invention enables the twin axle carrier to freely execute pendular motion about the tandem axle. It is only when the stop bar forming a prolongation of the pivot axle effectively engages the limit stop, in order either to adjust the vertical position of the vehicle chassis or to pivot the twin axle carrier, more particularly, in order to displace the center of gravity, that this free pendular motion is restricted in at least one direction.

Preferably the regulating device is designed such that it can effectively cooperate with the lever arm, for which purpose suitable motors are provided on the regulating device, which motors exert a rotational torque on the lever arm about the transverse axis of the machine. A rotational torque about the pivot axle, after a specific torque value has been reached, causes the twin axle carrier to pivot and thus raises one of its wheels. This leads to displacement of the center of gravity and, depending on the position of the raised wheel, either to an increase or to a decrease in the load on the rear wheel of the construction machine.

With this embodiment, it is possible to lock the pendular motion, or to change to the rigid axle function, for which purpose the regulating device need only be configured so as to transfer rotational torque to the lever arm between the pendulum axle and the pivot axle. As a result of this rotational torque, the guidance of the stop bar of the pivot axle within the free pendular motion space causes an effective engagement between the stop bar and the limit stop and thus blocks the pendular motion in at least one direction.

This regulating device or its power element is preferably disposed and designed such that the twin axle carrier can be pivoted about an axis parallel to the transverse axis of the machine, and, more particularly, such that it can be raised so as to lift a forward wheel from the ground. The transverse axis is a horizontal axis at right angles to the longitudinal axis of the machine and to its working direction. The use of a pivotal twin axle carrier, together with the configuration of a pendulum axle that is parallel to the pivot axle, the pendulum axle being effectively engaged by way of a lever arm and a regulating device being adapted to act on the pendulum axle so as to fix or to move the relative positions of the two axles, results in a machine that can have its center of gravity displaced very easily, and that can undergo vertical adjustment of its vehicle chassis in a very simple manner.

The regulating device has preferably at least one power element, and, in particular, a linear power element, which is connected to the lever arm in such a way that actuation of the power element causes a rotational torque to act on the lever arm. An example of such a power element is, in particular, a hydraulic cylinder.

Usually, there is provided a tandem axle unit of the above kind on each side of the construction machine. In this case, it is preferred that coupling means be present by means of which the regulating devices and, in particular, the hydraulic cylinders of the tandem axle units are optionally counteractingly coupled. Counteracting coupling exists when an adjustment of one of the regulating devices causes a counteracting adjustment of the other regulating device. For example, when the pendulum axle of one tandem axle unit is raised, there is simultaneous lowering of the pendulum axle on the other side.

For the actual configuration of the coupling means, recourse can be made to many alternative embodiments. However, in particular, with the use of hydraulic cylinders, coupling means involving an interconnecting pipeline between two hydraulic cylinders has proven to be particularly preferable. Hydraulic fluid is forced through this pipeline between the two hydraulic cylinders.

To ensure a stroke distance of the same magnitude on each side, the interconnecting pipeline is preferably designed such that the two cylinder chambers are in fluid communication with each other and the two annular chambers are independently also in fluid communication with each other. By the "annular chamber" is meant the interior cylinder chamber, in which the piston rod is present, and the "cylinder chamber" is accordingly the chamber in which no piston is present.

To allow the choice of operating options to be as wide as possible, the design of the hydraulic interconnecting pipeline is preferably such that it includes at least one stop valve, which can be toggled between an open position and a closed position. Fluid communication through the interconnecting pipeline can thus be created or blocked as desired.

The two-limbed lever arm is preferably a knee lever. A knee lever is, for example, an element in which the two limbs or shanks are disposed in a non-bendable manner at an angle of preferably from 45° to 135°, more preferably at 90°, to each other. One limb or shank of the knee lever is then preferably connected to the pendulum axle.

The pivot axle is in this case preferably disposed in the region of the knee of the knee lever. With such an arrangement, the engagement between the pivot axle and the free pendular motion space in the twin axle carrier can be easily achieved. It is furthermore very easy to apply a rotational torque to the twin axle carrier by means of a knee lever designed in this manner.

BRIEF DESCRIPTION OF THE DRAWINGS

The invention is further described below with reference to an exemplary embodiment illustrated in the drawings, in which.

DETAILED DESCRIPTION OF THE INVENTION

Figure 1:
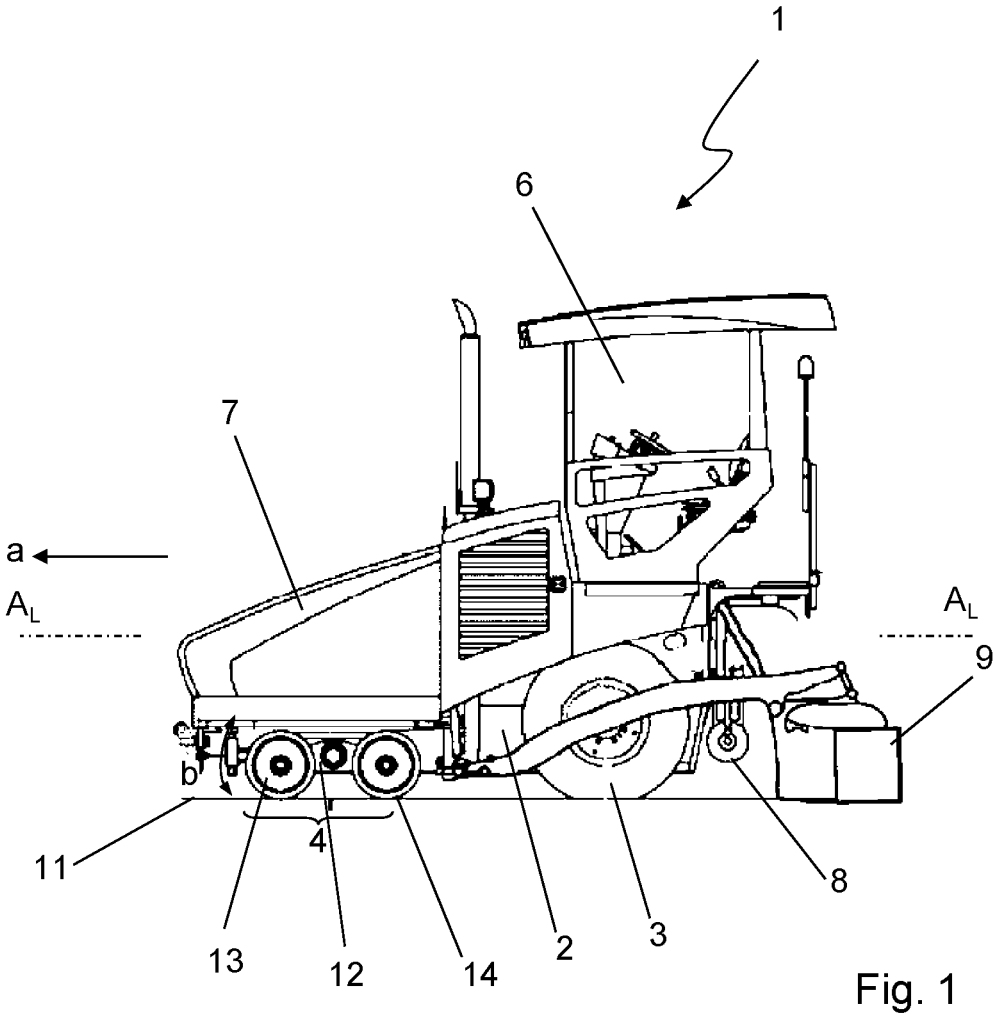
FIG. 1 is a side view of a road finisher.

FIG. 1 shows a self-propelled construction machine designed as a road finisher 1. The arrow a indicates the forward direction of travel. The road finisher 1 has at its front a material container 7 for accommodating construction material and, at the rear, a device 8 for spreading the construction material. The construction material is spread on the surface 11 by means of the spreading device and then flattened by means of a screed plate 9. The driver's cab is designated by the reference numeral 6.

The road finisher 1 has driving equipment with a pair of rear wheels and a pair of tandem axle units disposed at the front, the side view showing only the left-hand rear wheel 3 and the left-hand tandem axle unit 4.

The tandem axle unit 4 disposed at the front of the road finisher 1, as regarded in the direction of travel a, comprises a twin axle carrier 12, which is mounted on the road finisher 1 by way of a pendulum axle. The twin axle carrier 12 extends in the direction of the longitudinal axis $A_L$ of the road finisher 1. Drive elements comprising a front wheel 13 and a rear wheel 14 are disposed on the twin axle carrier 12 in the direction of the longitudinal axis $A_L$ of the machine 1, at a distance from each other. The wheels 13, 14 are mounted on the twin axle carrier 12 by means of a forward axle 16 and a rearward axle 17, respectively. The pendular motion carried out by the twin axle carrier is indicated by the double-headed arrow b.

Figure 2:
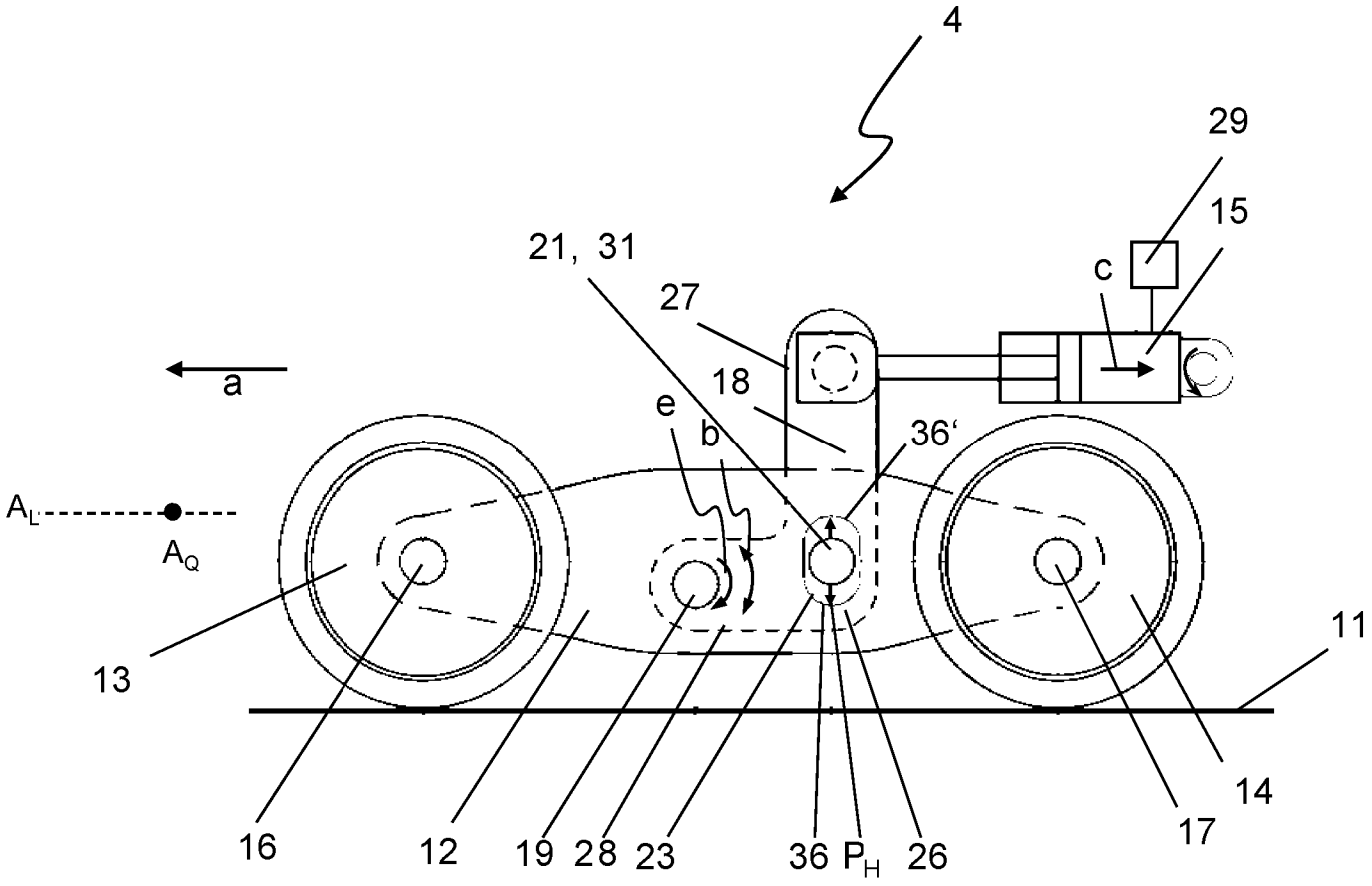
FIG. 2 is a detail showing a tandem axle unit of the road finisher illustrated in FIG. 1.

As seen in FIG. 2, the pendulum axle 19 is parallel to the transverse axis $A_Q$ of the road finisher 1. The pendulum axle 19 is mounted on a lever arm 18, which is mounted for pivoting about a pivot axle 21 on the vehicle chassis. The pivot axle 21 is parallel to the pendulum axle 19. Regarded statically, there is thus a diversion of load from the vehicle chassis 2 to the pivot axle 21, thence via the lever arm 18 to the pendulum axle 19 and thence to the twin axle carrier 12 and to the wheels 13, 14.

In the exemplary embodiment shown, the distance between the forward axle 16 and the pendulum axle 19 is shorter than the distance between the rearward axle 17 and the pendulum axle 19. Thus, the pendulum axle 19 lies off-center in relation to the forward and rearward axles 16, 17 on the twin axle carrier. The pendulum axle 19 is located between the forward axle 16 and the rearward axle 17. As regarded in the direction of travel a, the pivot axle 21 is situated behind the pendulum axle 19, that is to say, on that side of the pendulum axle 19 which is near the rearward wheel 14. The pivot axle 21 is thus positioned, likewise off-center, between the pendulum axle 19 and the rearward axle 17.

The lever arm 18 is designed as an L-shaped double-limbed knee lever, the pendulum axle 19 being disposed in a first limb 28. A second limb 27 is connected to a regulating device 15. When both wheels 13, 14 are in contact with a horizontal surface 11, as is shown in FIG. 2, the first limb 28 is substantially parallel to the longitudinal axis $A_L$, extending parallel to the twin axle carrier 12. In this case the second limb 27 is vertically aligned, and the direction of action of the regulating device 15 is substantially parallel to the longitudinal axis $A_L$.

As desired, a change in, or the fixation of, the pivoted position of the lever arm 18 can be carried out by means of the regulating device 15. The regulating device 15 is in this case designed as a double-acting piston/cylinder unit. In this way the lever arm 18 can be actively adjusted in either direction. Fixation of the pivoted position is brought about by locking the hydraulic volumes of the piston/cylinder unit.

Figure 3:
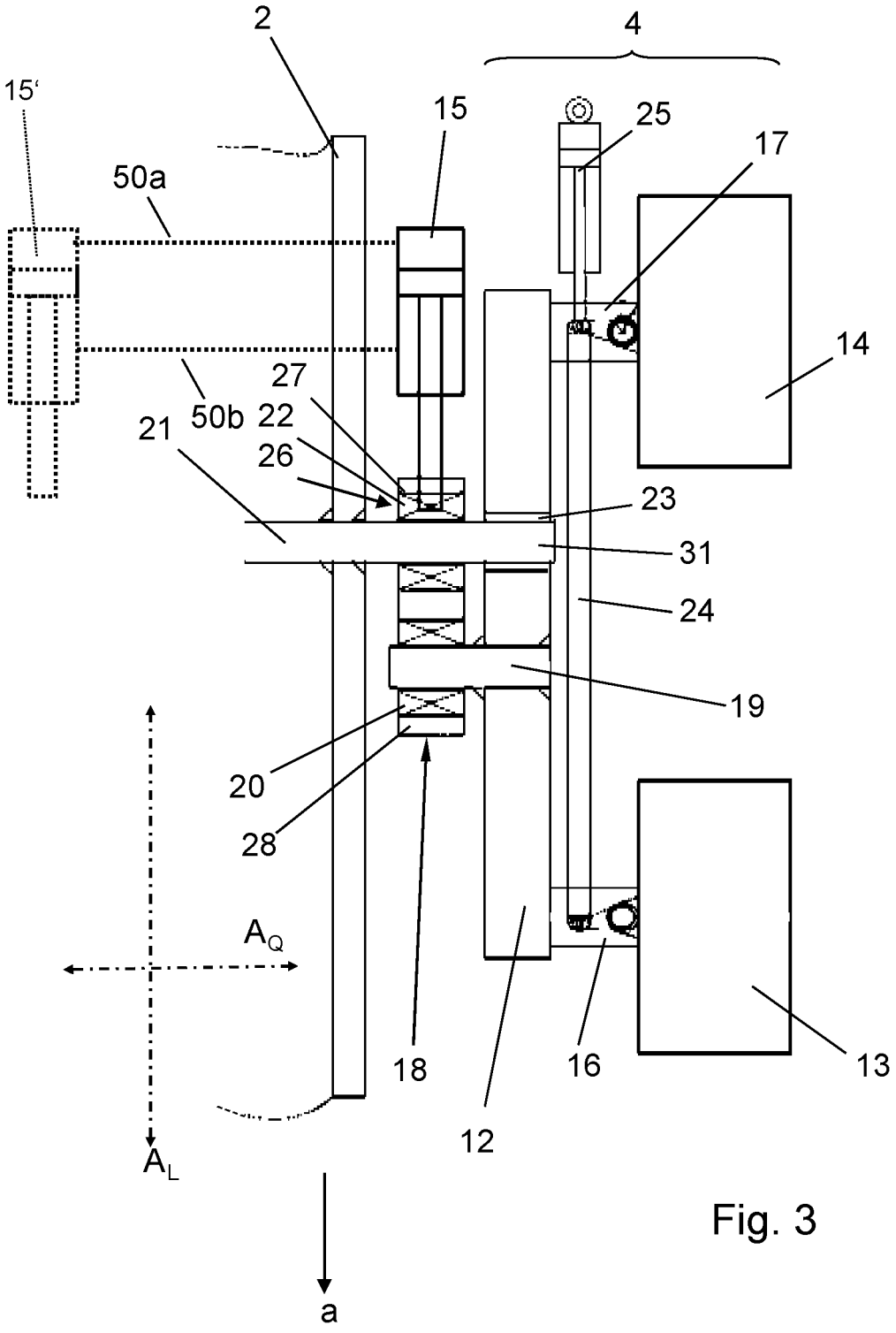
FIG. 3 is a horizontal cross-section through the tandem axle unit illustrated in FIG. 2.

As shown in FIG. 3, the lever arm 18 is located between the vehicle chassis 2 and the tandem axle unit 4, on the outer side of which the wheels 13, 14 are situated. The lever arm is mounted on the pivot axle 21 by means of a pivot bearing 22, which pivot axle is rigidly attached to the vehicle chassis. The pendulum axle 19 is rigidly attached to the twin axle carrier 12, and passes through a pivot bearing 20 to engage in the first limb 28.

As further shown in FIGS. 2 and 3, the pivot axle 21 is disposed in the knee region 26 of the lever arm 18 such that it passes through the lever arm to engage, together with a coaxial stop bar 31, a free pendular motion space in the twin axle carrier 12. In this case, the free pendular motion space 23 is embodied as an elongated hole 23, of which the shorter sides form the lower limit stop 36 and the upper limit stop 36', respectively, for the stop bar 31. In the pivoted position shown in FIG. 2, the stop bar 31 is in the middle of the free pendular motion space (the elongated hole 23), so that the twin axle carrier 12 can execute pendular motion freely within the free pendular motion space to either side. The twin axle carrier 12 and the lever arm 18 can thus be pivoted relatively to each other to either side, to the extent permitted by the free pendular motion space.

The limit stops 36, 36' restrict the pendular motion b of the twin axle carrier 12 about the pendulum axle 19. When the twin axle carrier 12 is sufficiently deflected that one of the shorter sides of the elongated hole 23 hits the stop bar, the pendular motion b is restricted, so that the maximum possible pendulum axle stroke is achieved, designated here by $P_H$.

In the "pendular position" shown in FIG. 2 the twin axle carrier 12 with its attached wheels 13, 14 can execute pendular motion freely about the pendulum axle 19, as long as the pendular motion remains within the maximal pendulum axle stroke $P_H$ as restricted by the limit stops 36, 36'. The purpose of the pendular position is that the regulating device 15 connected to the second limb 27 of the lever arm 18 determines the relative position of the pivot axle 21 with respect to the twin axle carrier 12. To this end, the regulating device 15 can be locked as regards its piston position. Since the first limb 28 of the lever arm 18 that transfers the load from the pivot axle 21 to the pendulum axle 19, is connected to the twin axle carrier 12 in a freely deflectable way, the torque forces arising from the eccentricity of the pendulum axle 19 and the pivot axle 21 must be absorbed by the regulating device. When the regulating device 15 is locked in such a way that the piston is held motionless in the cylinder, the tandem axle unit 4 is held in the pendular position shown.

In this case, the regulating device 15 is equipped with a force detecting element 29, using which the linear force C acting on the regulating device can be ascertained by means of a pressure sensor. This force provides information concerning the axle load on the front wheel 4. The result of this measurement can be implemented to adjust the traction of the tandem axle unit by effecting appropriate regulation of the pressure in the hydraulic power units of the tandem axle unit.

The stop bar 31 in this case forms an integral part of the pivot axle 21. It forms a prolongation of the pivot axle 21 and passes through the lever arm 18 in the region of its knee. To allow the stop bar 31 to move as smoothly as possible within the free pendular motion space, or the elongated hole 23, this elongated hole 23 is a little broader than the diameter of the stop bar 31 to provide a little more free space, as shown in FIG. 3.

To allow the machine 1 to be steered, the wheels 13, 14 of the tandem axle unit 4 are connected by a steering linkage, which can be actuated by a piston/cylinder unit 25.

Figure 4:
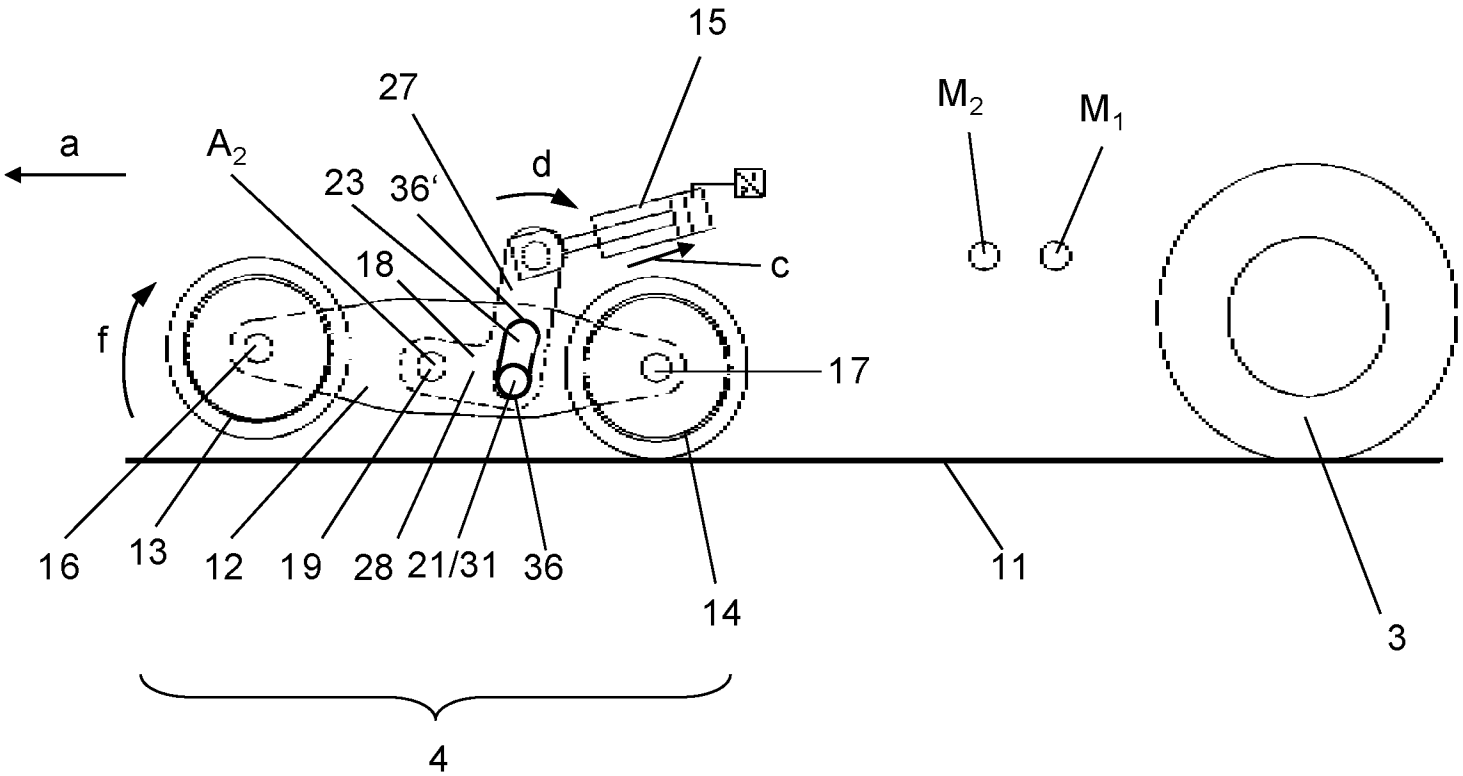
FIG. 4 is a detail showing the driving equipment of the road finisher illustrated in FIG. 1, in rigid axle mode.

While FIG. 2 shows the tandem axle unit during pendular motion mode, FIG. 4 shows a so-called rigid axle mode, in which the twin axle carrier 12 is rotated about the transverse axis $A_Q$ of the machine 1 in such a way that the forward wheel is raised.

As shown in FIG. 4, the raising of the front wheel 13 leads to a displacement of the center of gravity of the road finisher 1 from a first position designated by $M_1$ during the pendular motion mode of operation, forward to a position designated by $M_2$. This displacement of the center of gravity reduces the load on the rear wheel 3. Thus by changing from pendular motion mode to rigid axle mode it is possible, inter alia, to displace the center of gravity $M_1$ of the machine forward in the direction of travel a to position $M_2$ and in this way to reduce the axle load on the rear wheel 3.

The change from pendular motion mode to rigid axle mode takes place by actuation of the lever arm 18 by means of the regulating device 15. Clockwise movement of the lever arm 18 causes it to rotate about the pivot axle 21, as indicated by the arrow d, to the position shown in FIG. 4.

This rotation of the lever arm 18 causes an upward force to act on the pendulum axle 19. This results in a levering effect on the twin axle carrier 12, by which means the rearward wheel 14 acts as a fulcrum and the forward wheel 13 is lifted off the ground 11 and raised, as indicated by the arrow f.

This means that the free pendular motion space (i.e., the elongated hole 23) of the twin axle carrier 12 is deflected about the pendulum fulcrum PH (cf. FIG. 2) upwardly to an extent such that the stop bar 31 of the pivot axle 21 engages the lower limit stop 36. Pendular motion of the twin axle carrier 12 is consequently no longer possible. This position is advantageous, not only for balancing out axle loads, but also when traveling over steps and similar protrusions.

The regulating device 15 returns to pendular motion mode when the lever arm 18 is pivoted counterclockwise (the direction opposite to the arrow d), by which means the first limb 28 of the lever arm 18 is pivoted downwardly. This brings the forward wheel 13 back into contact with the ground. Further counterclockwise pivoting of the lever arm 18 raises the vehicle chassis 2 together with the pivot axle 21, until the twin axle carrier 12 can once more execute pendular motion freely, as has been described with reference to FIG. 2.

Figure 5:
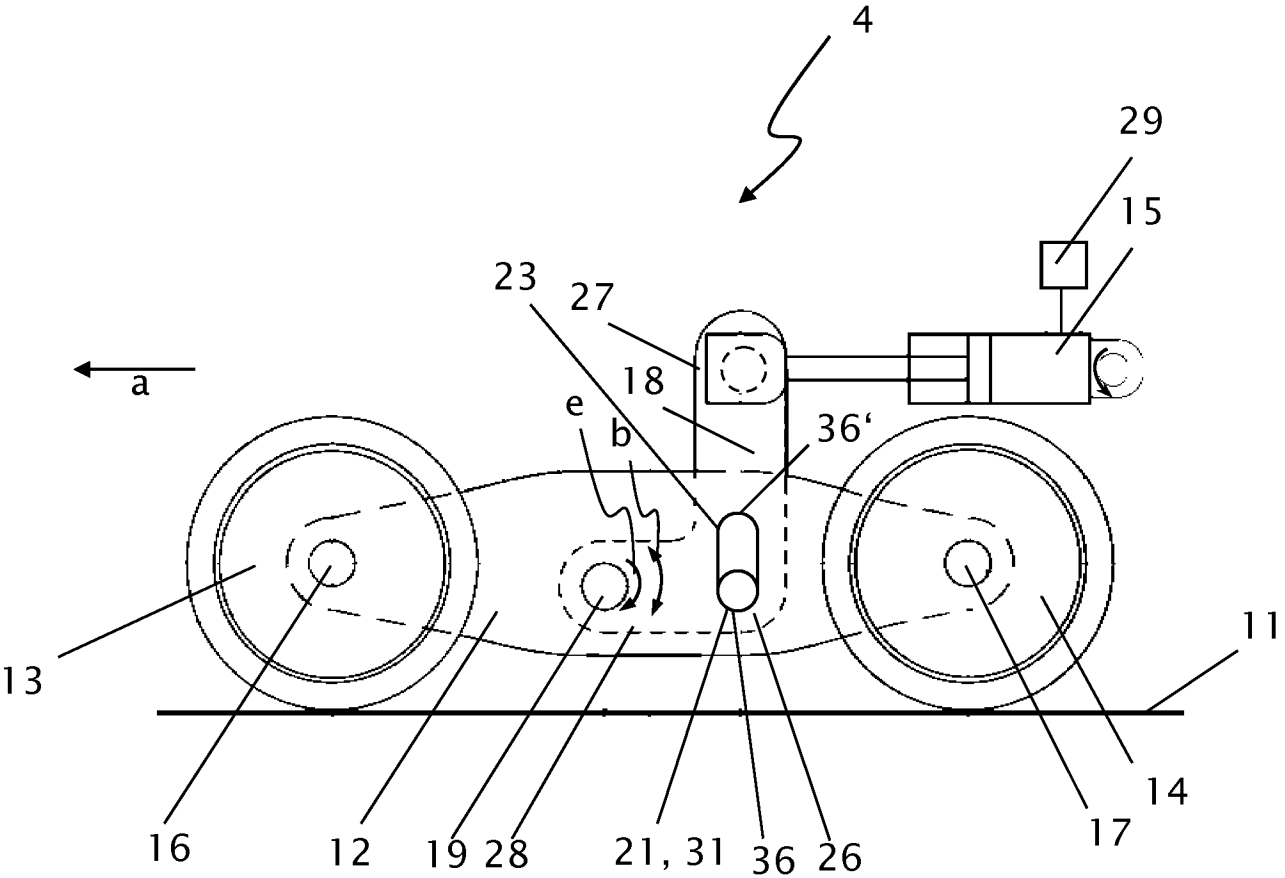
FIG. 5 is a detail showing the driving equipment of the road finisher illustrated in FIG. 1 with the chassis in a lowered position.

When the lever arm 18 is pivoted clockwise (in the direction of the arrow d) by the regulating device 15, as shown in FIG. 5, until the lower limit stop 36 is reached, this causes the vehicle chassis 2 to be lowered. In this way the material container 7 (FIG. 1) is also lowered, which is advantageous when loading construction material from a freight vehicle. This movement can take place without applying power to the regulating device 15 but simply by implementation of the weight of the construction machine when the retention force exerted by the regulating device 15 on the lever arm 18 is reduced to the point at which the pivot axle 21 sinks due to the vehicle weight resting thereon.

Conversely, rotation of the lever arm 18 in a counterclockwise direction, causes the machine chassis to be raised until the upper limit stop 36' is reached. In this case, the rearward wheel 14 of the tandem axle unit 4 is raised from the ground. In this way it is possible to increase the ground clearance of the construction machine 1 during certain maneuvering functions of the vehicle.

Adjustment of the left-hand tandem axle unit 4 as described above is available in the same way for the right-hand tandem axle unit. Each side can be controlled, as desired, independently of the other. That is to say, the left-hand and the right-hand tandem axle units can be configured and operated in pendular motion mode or in rigid axle mode independently of each other. If both forward wheels 13 are raised from the ground 11, this is referred to as longitudinal pendular action.

Furthermore, the forward wheels 13 of each of the left-hand and right-hand tandem axle units 12 can be raised from the ground 11 independently of the other. In addition, it is also possible to raise and lower the left and right sides of the vehicle chassis in the manner described above, independently of each other. On sloping ground, this allows the construction machine to be leveled out in relation to its transverse axis $A_Q$.

In this context the pressure applied to the regulating device 15 by means of the left-hand and right-hand power elements 29 can also be used for leveling the screed plate 9. The independent adjustment of the left and right sides of the vehicle chassis 2 by means of the respective regulating device is referred to as transverse pendular action.

Figure 6:
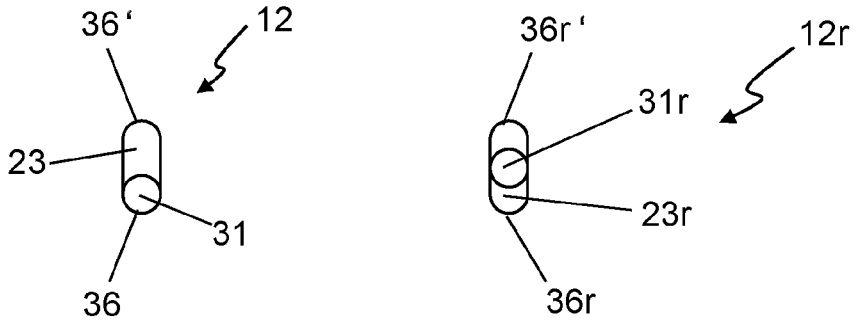
FIG. 6 is a detail demonstrating different vertical positions of the left-hand and right-hand tandem axle units.

As an example of transverse pendular action, FIG. 6 illustrates a situation in which the left-hand tandem axle unit 4 is in rigid axle mode and the right-hand tandem axle unit is in pendular motion mode. To keep the diagram simple, only the elongated hole 23 of the left-hand twin axle carrier 12, the elongated hole 12*r* of the right-hand twin axle carrier 12*r* with the respective lower and upper limit stops 36 and 36*r*, as well as the associated pivot axles 31 and 31*r*, respectively, are shown. As shown, the left-hand stop bar 31 is present at the lower limit stop 36 and the right-hand stop bar 31*r* is between the lower and upper limit stops 36*r*, 36*r*' respectively.

Figure 7:
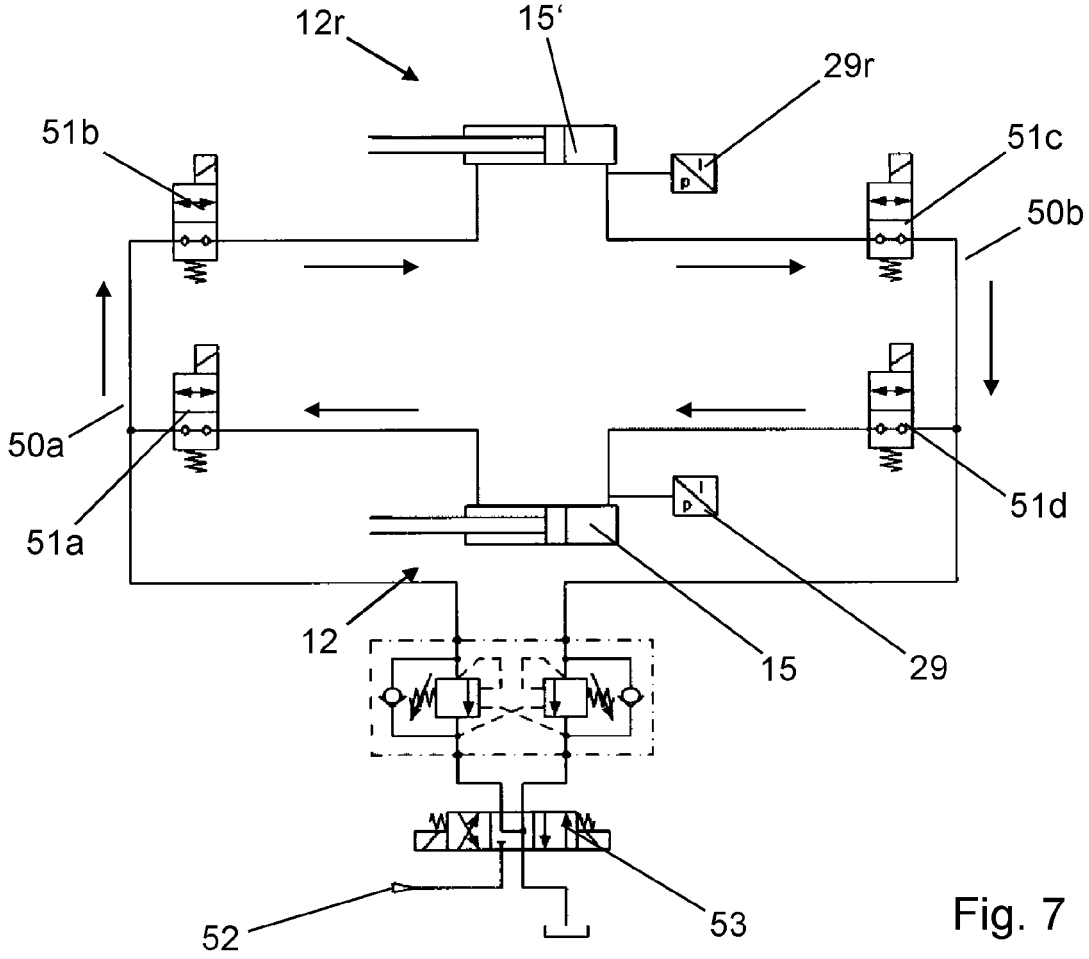
FIG. 7 is a hydraulic circuit diagram showing the interconnections between the two tandem axle units.

This longitudinal pendular action, that is, a balancing of machine movements about the longitudinal axis $A_L$, may also be achieved, to a certain extent, by coupling the two tandem axle units 4 by means of a coupling device. This is indicated diagrammatically in FIG. 3 by the interconnection of the two hydraulic cylinders 15 and 15'. Here the hydraulic cylinder 15' is representative of a complete tandem axle unit 4. FIG. 7 illustrates the coupling in greater detail. The feature here is that this coupling can accomplish a reverse vertical adjustment of the pendulum axle 19 in relation to the machine chassis, so that the construction machine can remain horizontally aligned when traveling over obstacles on one side. Connecting pipes 50*a* and 50*b* serve this purpose, where the pipe 50*a* provides fluid communication between the annular chambers and the pipe 50*b* fluid communication between the cylinder chambers of the piston/cylinder units 15 and 15'. When the piston/cylinder unit 15' retracts, this results in a protracting counter-movement of the piston/cylinder unit 15, as indicated by the corresponding arrows in FIG. 7. To summarize, this makes it possible to absorb elevated obstacles while maintaining horizontal alignment of the construction machine.

To make it possible to implement this leveling functionality optionally or on only one side, stop valves 51*a* to 51*d* are disposed in the hydraulic circuit. These valves can be toggled between a closed position, in which no passage of hydraulic fluid is possible, and an open position in which hydraulic fluid can flow. Each of these valves is disposed in the circuit upstream of the respective cylinder and annular chambers. The switched position of the valves can be controlled by the user or optionally by a machine control unit. When the valves 51*a* to 51*d* are open, longitudinal pendular action about the transverse axis $A_Q$ is available, allowing for absorption of unevenness of the ground between the two tandem axle units.

Furthermore, pressure is supplied by a hydraulic pump 52 over a ¾ way valve 53 to the interconnecting pipes 50*a* and 50*b*, by means of which the desired position of the piston/cylinder units 15 and 15' can be changed on one or both sides as desired, e.g., for rigid axle mode as described above and/or for one sided or two-sided raising or lowering of the construction machine. To this end, the respective supply pipes merge into the connecting pipes 50*a* and 50*b* between the two limit valves 51*a* and 51*b* pertaining to the annular chambers, and the two limit valves 51*c* and 51*d* pertaining to the cylinder chambers.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. A self-propelled construction machine, comprising:

a vehicle chassis and having a tandem axle unit and a single wheel on each side of the vehicle, wherein each tandem axle unit comprises a twin axle carrier at which a front wheel and a rear wheel are arranged, and a regulating device configured to pivot said twin axle carrier relative to the vehicle chassis, wherein each tandem axle unit further comprises a lever arm mounted on a pivot axle which is attached to the vehicle chassis, and wherein the twin axle carrier is attached to the lever arm via a pendulum axle mounted on the lever arm which is disposed for rotation about the pivot axle on the vehicle chassis, and further wherein said regulating device engages said lever arm.

2. The machine according to claim 1, wherein said lever arm is two-limbed having a first limb and a second limb, and further wherein said tandem axle unit is disposed on the first limb and said regulating device engages said second limb.

3. The machine according to claim 2, wherein said two-limbed lever arm is in the form of an L-shaped lever arm, wherein said first limb is substantially horizontally oriented and said second limb is substantially vertically oriented.

4. The machine according to claim 1, wherein said lever arm is disposed between said vehicle chassis and said tandem axle unit.

5. The machine according to claim 1, further comprising a limit stop is configured to restrict pivotal motion of said twin axle carrier on said tandem axle unit.

6. The machine according to claim 5, wherein said limit stop is configured such that a prolongation of the pivot axle is guided in an opening in the twin axle carrier.

7. The machine according to claim 6, wherein said opening is in the form of an elongated hole whose ends serve as an upper and lower limit stop, respectively.

8. The machine according to claim 1, wherein said pivot axle of said lever arm is disposed on that side of a pendulum axle on which the single wheel is disposed.

9. The machine according to claim 7, wherein said pivot axle of said lever arm is disposed between said pendulum axle and a wheel of said tandem axle unit which is opposite to said single wheel.

10. The machine according to claim 1, wherein said regulating device comprises a double-acting hydraulic cylinder.

11. The machine according to claim 1, wherein said regulating device is capable of being locked in a specified angular position of said lever arm, in which a wheel on the tandem axle unit is raised from the ground, such that said tandem axle unit acts as a rigid axle.

12. The machine according to claim 1, wherein said regulating device comprises at least one force detecting element.

13. The machine according to claim 1, wherein a coupling device is provided, by means of which said regulating devices of the tandem axle units are counteractingly coupled to each other.

14. The machine according to claim 13, wherein said coupling device comprises an interconnecting pipeline between two hydraulic cylinders pertaining to said regulating device.

15. The machine according to claim 14, wherein said interconnecting pipeline is configured such that all of the cylinder chambers and annular chambers of the two hydraulic cylinders are in fluid communication with each other.

16. The machine according to claim 14, wherein at least one stop valve, which can be toggled between an open position and a closed position, is included in said interconnecting pipeline.

17. The machine according to claim 11, wherein said lever arm and a lifting element in each case form a limb of a knee-shaped lifting element.

18. The machine according to claim 17, wherein said pivot axle is mounted in a region of the knee of said knee-shaped lifting element.

19. The machine according to claim 1, wherein said machine comprises a road finisher.

20. The machine according to claim 18, wherein said pivot axle passes through said knee-shaped lifting element.

* * * * *